US005711033A

United States Patent [19]

Green et al.

[11] Patent Number: 5,711,033

[45] Date of Patent: Jan. 27, 1998

[54] AIR FILTRATION AND CONTROL SYSTEM INCLUDING HEAD GEAR

[75] Inventors: Lawrence J. Green, Hungtinton Beach; Harry Nicholas Herbert, San Juan Capistrano, both of Calif.

[73] Assignee: Bio-Medical Devices, Inc., Irvine, Calif.

[21] Appl. No.: 539,708

[22] Filed: Oct. 5, 1995

[51] Int. Cl.[6] ..... A42B 3/00

[52] U.S. Cl. ..... 2/171.3; 2/424

[58] Field of Search ..... 2/171.3, 422, 424, 2/436, 202, 205, 206; 128/201.15, 201.22, 201.23, 201.24, 201.25, 206.19

[56] References Cited

U.S. PATENT DOCUMENTS

| | | | |
|---|---|---|---|
| 1,184,785 | 5/1916 | Stern | 128/201.15 |
| 3,963,021 | 6/1976 | Bancroft | 2/171.3 |
| 4,127,130 | 11/1978 | Naysmith | 128/201.25 |
| 4,619,254 | 10/1986 | Moretti et al. | 128/201.23 |
| 4,730,612 | 3/1988 | Dampney | 2/171.3 |
| 5,022,900 | 6/1991 | Bar-Yona et al. | 128/201.25 |
| 5,054,480 | 10/1991 | Bare et al. | 128/201.25 |
| 5,104,430 | 4/1992 | Her-Mou | 2/171.3 |
| 5,125,402 | 6/1992 | Greenough | 128/201.25 |
| 5,245,994 | 9/1993 | Chang et al. | 2/171.3 |

FOREIGN PATENT DOCUMENTS

| | | | |
|---|---|---|---|
| 2220574 | 1/1990 | United Kingdom | 128/201.22 |

*Primary Examiner*—Michael A. Neas

*Attorney, Agent, or Firm*—G. Donald Weber, Jr.

[57] ABSTRACT

An air flow and filtration control system in the form of a headgear which is worn by a physician during a surgical procedure, a technician during an assembly process, or any other user wherein controlled air flow and air filtration is required or desired. The flow-through system includes a relatively rigid, open frame, skeleton headgear structure which substantially surrounds the head of the wearer. A fan is mounted in the headgear structure. The fan is positioned to move air through ducts formed in the headgear structure. A shroud (or hood) is draped over and attached to the headgear structure in such a fashion as to completely cover the headgear structure and to cover at least a portion of the wearer in order to maintain sterile or controlled conditions relative to the wearer. The shroud includes filtration areas which may encompass the entire shroud. The filtration areas may be disposed adjacent to the fans when the shroud is placed over the headgear structure. A relatively planar transparent screen or "window" is provided at the front of the apparatus for substantially undistorted viewing. Typically, the transparent screen is mounted in the shroud and is removable therewith. A suitable power supply, such as a battery pack or the like, is used to selectively power the fans. It is anticipated that at least the shroud (and the components mounted thereto) will be disposable.

23 Claims, 6 Drawing Sheets

AIR FILTRATION AND CONTROL SYSTEM INCLUDING HEAD GEAR

BACKGROUND

1. Field of the Invention

This invention is directed to air flow and filtration systems, in general, and to a headgear structure which is worn by an individual in an environment wherein control of filtered air is required, in particular.

2. Prior Art

There are several types of air flow and/or filtration systems which are known in the art. Several types of such systems are currently available on the market for use in surgical or "clean room" environments.

Some of the existing systems have a bulbous or hemispherical, transparent viewing screen which creates substantial distortion for the wearer. In the case of surgical procedures, especially very delicate surgical procedures, any type of visual distortion is undesirable. Such distortion can create a situation with significant safety problems. Moreover, this distortion can create substantial fatigue in the surgeon because of the additional intensity required to compensate for the distortion during the surgical procedures.

Similarly, in "clean room" situations, such distortion can be a problem in terms of fatigue, inaccurate or imprecise procedures and the like. This can result in the fabrication of defective products or the like.

Furthermore, many of the systems known in the art tend to produce an uneven airflow therethrough. This has the effect of creating drafts in some locations and little or no airflow in other locations within the system. This situation can sometimes result in the transparent screen or shield becoming fogged due to condensation of expired air generated by the surgeon or technician during the procedures involved.

Also, in some systems the transparent shield is separated from the protective hood. This arrangement permits air to flow around the shield. However, it also permits contamination to pass around the shield, as well. Thus, contaminated air or undesirable substances can come into contact with the wearer. Conversely, the wearer can provide contaminated air, or the like, to the work space.

Some of the existing systems include hoods, gowns, filters and the like. In some instances, the filters are built into the helmet structure and produce a rather clumsy, cumbersome headgear unit. Known units frequently include external sources such as gas cylinders, air lines or the like which are connected to the helmet structure by tubes, hoses or the like. Of course, the hose-connected systems tend to become cumbersome and restrictive in the movements and flexibility of the wearer during a procedure.

PRIOR ART STATEMENT

The best known prior art is listed herewith. Other prior art systems may exist and this list is not warranted to be total and/or complete.

Prior Art Products

STACKHOUSE: Surgical Helmet Systems (FREEDOM, TM).

INTERSAFE INTERNATIONAL B. V.: Cleanroom Airhood (MICROSAFE TM).

DE PUY: Surgical Exhaust System (STERILE VIEW TM).

Prior Art References

One suitable and functional system is described in U.S. Pat. No. 5,054,480, PERSONAL AIR FILTRATION AND CONTROL SYSTEM, R. O Bare et al. Reference is made to this patent the references cited therein.

SUMMARY OF THE INSTANT INVENTION

A protective system which is worn by a surgeon during a surgical procedure, a technician during an assembly process, a worker during handling of toxic wastes, or the like. The system includes a relatively light weight, substantially rigid, headgear structure which is attached to an internal, adjustable headband. The headband includes straps for specifically adjusting the size thereof to the wearer. At least one fan is mounted in the headgear structure. The fan includes a unique design which provides improved operation at relative low speeds. A suitable power supply, such as a battery pack or the like, is used to selectively power the fan.

The system also includes a relatively limp or flaccid fabric-like shroud which is adapted to be attached to or draped over the headgear structure to completely cover the structure and, as well, to cover a portion of the wearer in order to maintain sterile, non-contaminating conditions relative to the wearer. The shroud includes at least one filtration area which is, typically, arranged to be disposed adjacent to the fan in the headgear structure. The entire shroud may be fabricated off filtration material.

A transparent screen is included in the shroud. Typically, the screen is curved in one plane and is arranged to be disposed at the front of the headgear structure for relatively undistorted viewing by the wearer.

DESCRIPTION OF A PREFERRED EMBODIMENT

Figure 1:
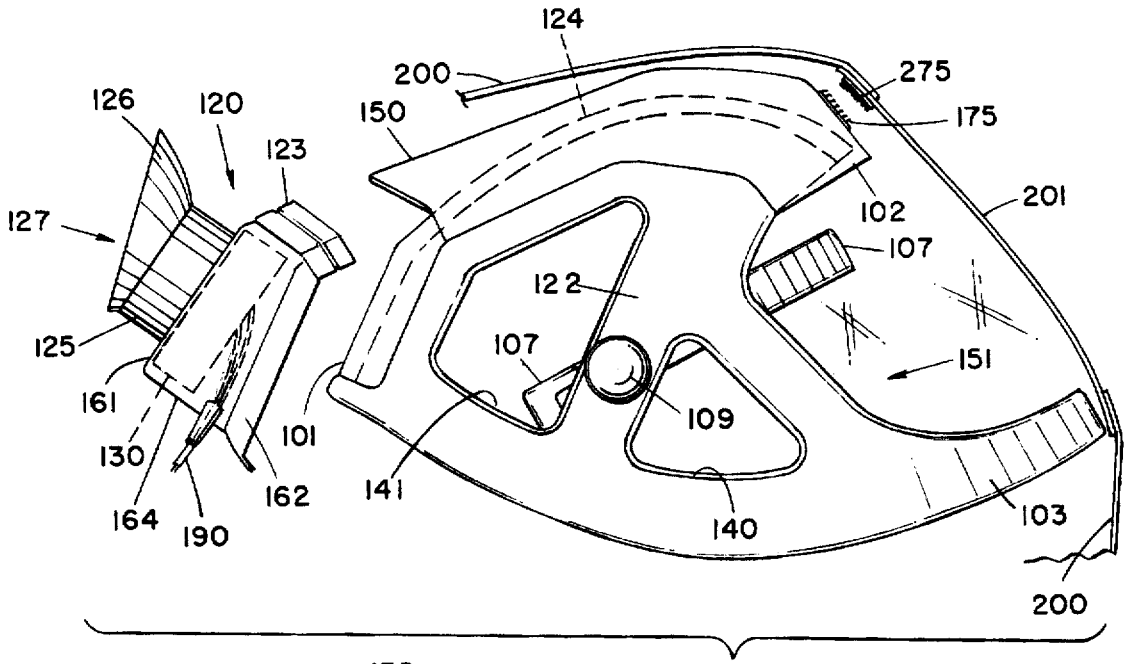
FIG. 1 is a partially exploded, side or elevation view of one embodiment of the headgear structure of the instant invention.

Referring now to FIG. 1 there is shown a side or elevation view of one embodiment of the air flow system of the instant invention. The system includes a relatively rigid headgear structure 100 which is selectively covered by a relatively limp shroud 200. For convenience, only a portion of shroud 200 is shown, in cross-section, in FIG. 1. The shroud 200 is, preferably, formed of fabric, non-woven fabric, polypropylene or similar materials, as noted. The shroud includes a transparent, planar viewing shield 201.

The headgear structure 100 is adapted to be placed over (but spaced away from) the head of the wearer. The upper (or cranial) portion 150 is configured to substantially follow the generally oval contour of a human head. The outer surface of upper portion 150 of the headgear structure 100 is shown to be relatively smooth. An internal liner 124 (shown in dashed outline) follows the contour of the surface of the upper portion 150. The liner 124 is spaced away from the inner surface of the upper portion 150 and forms a channel or duct therebetween. The back 101 of the headgear structure 100 is adapted to be spaced away from the back of the head of the wearer.

The front 102 of the upper portion 150 of the headgear structure 100 is designed to be spaced above and forwardly away from the wearer thereof so that the shroud 200 (or hood) depends from structure 100 but is spaced away from the wearer's face.

A suitable attachment mechanism 175, such as a tacky adhesive strip, a hook-and-loop material (such as sold under the Trademark Velcro), or the like, is affixed to the outer surface of the front portion 102. A complementary attachment mechanism 275 is, typically, provided on the inner surface of the shroud 200 to mate with attachment mechanism 175. This attachment mechanism operates to retain shroud 200 in the preferred orientation relative to the headgear structure 100 and to prevent inadvertent movement thereof.

The headgear 100 includes side sections 151. The side sections 151 of the structure 100 also include openings 140 and 141 therein. The shape of these opening is not critical. The openings 140 and 141 are somewhat cosmetic and permit better hearing capabilities for the wearer. The openings may also reduce the amount of material used in the headgear 100 in order to reduce the cost and the weight thereof.

The side sections 151 include a central strut 122 between openings 140 and 141 which is arranged to be placed at approximately the temporal position of the wearer's head. The central (or temporal) strut 122 provides a mounting location for an internal support liner 107, as described hereinafter.

The lower front portion 103 extends forwardly from the side sections 151 and is curved to form a support bar adjacent to the wearer's head in the region of the jaw. The lower front portion 103 is adapted to be spaced away from the wearer's face. Thus, the front portion 103 maintains the shroud 200 spaced away from the wearer's face.

In a preferred embodiment, the headgear 100 including upper portion 150, upper front portion 102, back 101, side section 151, temporal portion 122 and lower front portion 103 is integrally formed of a high strength, high impact, lightweight plastic material such as ABS polycarbonate, or the like. Typically, the structure 100 can be stamped, injection molded, blow molded, vacuum formed or produced by any other suitable process. Of course, the entire structure 100 should be relatively lightweight and properly balanced so as to reduce tension and fatigue when worn.

The back portion 101 of the headgear structure substantially encloses the back of the head of the wearer but is adapted to be spaced therefrom. The back portion 101 is relatively flat and is used to mount the fan housing 120 (described infra). One or more high efficiency fans or blowers 130 (shown in dashed outline) can be mounted at the back 101 of upper portion 150 of the helmet in housing 120. Fan housing 120 includes a back wall 161 which is substantially parallel to helmet back 101 when the housing 120 is mounted on the headgear structure 100. Sidewalls 162, top wall 163 and bottom wall 164 extend from the back wall 161 and abut back 101 of headgear 100. Thus, fan housing 120 forms a plenum which communicates with the space between the inner surface of top portion 150 of headgear structure 100 and liner 124.

Fan 130 is mounted on back wall 161 adjacent to an aperture therethrough. The aperture communicates with outlet port 125. The port 125 includes the flared end 126 which communicates with shroud 200 as described infra. Typically, the fan 130 is a relatively small flat fan as described in detail hereinafter. Power is supplied to fan 130 via electrical conductor 190.

A suitable battery pack or other power source (not shown) is connected to the headgear 100 by any suitable fashion so as to provide the appropriate power to the fans and yet be unobtrusive and out-of-the-way for the wearer of the headgear. Typically, the power supply can be mounted to other garments of the wearer in any convenient fashion and is connected to the electrical components by means of a wire or cable 190.

An internal headband 107, similar to headbands found in other headgear, is mounted to the central strut 122 of the headgear structure 100 by a pivotal mounting which is adjustably secured by a knob 109. In order to position the headgear structure 100 relative to the headband (and the wearer's head), knob 109 is selectively loosened or tightened. With the headband 107, the headgear structure 100 and the shroud 200 supported thereby do not rest directly on the wearer's head. This arrangement permits air flow and circulation around the wearer's head, as described infra.

In a preferred embodiment, air flow is generated from the back of the headgear by fan 130. The air flow is between the inside surface of the headgear structure 100 and the inner liner 124. Typically, the air passes forwardly across the top of the wearer's head and down across the face of the wearer thereby to minimize perspiration or the like. In addition, the air flow inhibits and/or minimizes the possibility of condensation on the inner surface of the transparent shield 201 in shroud 200. (Of course, the air can be drawn out of the headgear structure by means of fan 130 when it is operated as an exhaust fan.)

The shroud 200 is attached to the port 125 by an attachment device (described infra) such that the air inlet (or outlet) area is covered by a filtration area of the shroud 200. Thus, the airflow passes from the ambient airspace, through the filter portion of the shroud 200, through the port 125 and through the fan 130 in housing 120.

Figure 2:
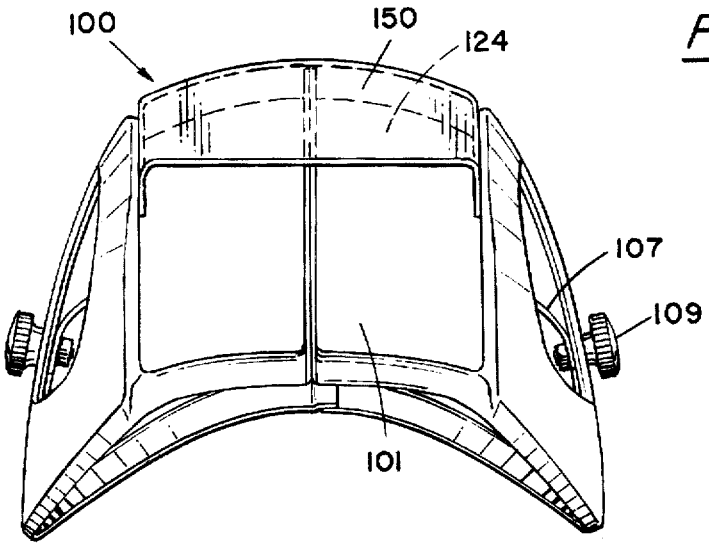
FIG. 2 is a rear view of the embodiment of the instant invention shown in FIG. 1 with the fan unit removed for convenience.

Referring now to FIG. 2, there is shown a rear, elevation view of the headgear structure (or helmet) 100. The fan housing 120 is removed for convenience. The surface of upper portion 150 is shown to be relatively smooth and rounded. The knob 109 for adjusting the headliner 107 is shown at the side of the helmet.

The back surface 101 is shown to be, generally, smooth and, effectively, an extension of the liner 124. In essence, the back surface 101 provides one surface of the housing 120 for fan 130. When the housing 120 is attached to the headgear structure 100, the interior plenum thereof extends into and communicates with the airspace between liner 124 and the inner surface of the upper portion 150. Thus, the housing 120 becomes an effective extension of the duct.

Figure 3:
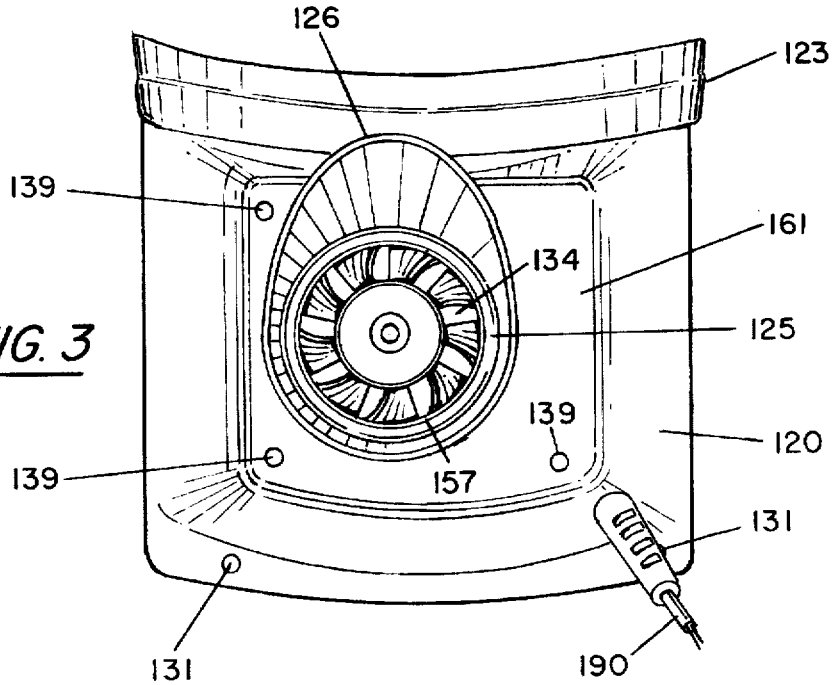
FIG. 3 is a rear view of one embodiment of the fan unit used with the headgear structure embodiment shown in FIG. 1.

Referring now to FIG. 3, there is shown an elevation view of the outside of housing 120. The housing 120 is formed of the same material as the headgear 100 and is attached thereto by suitable fasteners which pass through apertures 131 at the bottom thereof. A sealing strip 123 of suitable material such as a foam rubber, is affixed to the upper portion of the housing 120 and forms an air seal between the inner surface of headgear 100 and the housing 120. The fasteners 139 are used to attach the fan 130 to the housing 120. Of course, any suitable fastening technique can be utilized.

The port 125 can be integrally formed with or attached to the housing 120. The port includes an enlarged outer edge or rim 126 which is used to engage the shroud 200 as described hereinafter. The impeller 134 of fan 130 is disposed at the opening 157 through back wall 161 of housing 120 and is, effectively, surrounded by port 125.

Figure 4:
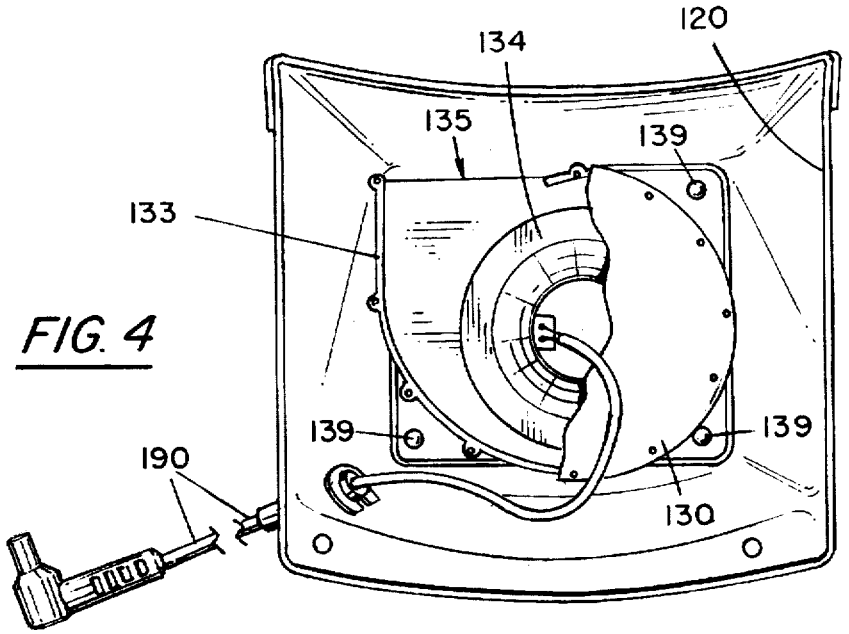
FIG. 4 is a front view of the fan unit shown in FIG. 3.

Referring now to FIG. 4, there is shown an elevation view of the inside of housing 120 with fan 130 mounted thereon. Fan 130 is shown partially broken away in order to illustrate the volute 133 and the impeller 134. The opening 135 in the volute communicates with the duct between liner 124 and the inner surface of the top portion 150 of helmet 100 so that air can be moved by the fan. The impeller 134 causes the air to pass through the opening 157 in the port 125 (see FIG. 3). The direction of the air passing through port 125 depends upon whether fan 130 is an intake or an exhaust fan.

Figure 5:
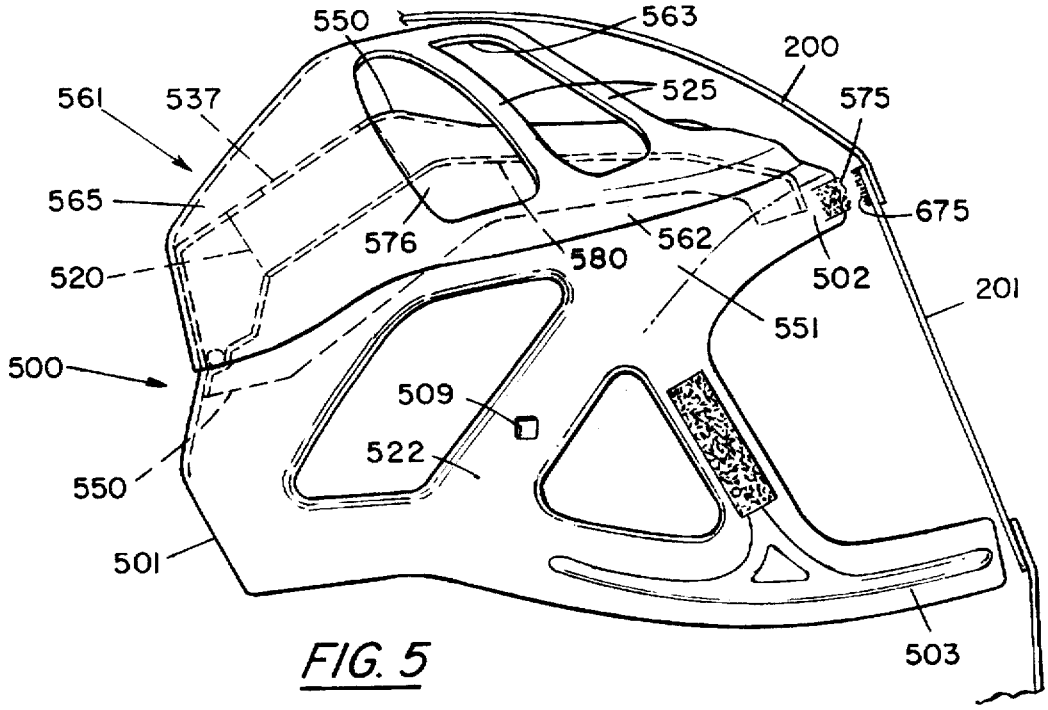
FIG. 5 is a side or elevation view of another embodiment of the headgear structure of the instant invention.

Referring now to FIG. 5 there is shown a side or elevation view of another embodiment of the instant invention. In this embodiment, similar components bear related reference numerals. The system includes a basic, relatively rigid headgear structure 500 which is selectively covered by a relatively limp shroud 200 (only a portion of shroud 200 is shown in cross-section in FIG. 5).

The headgear structure 500 is substantially similar to the structure 100 shown in FIG. 1 and can be fabricated in the same manner. That is, the upper (or cranial) portion 550 is configured to substantially follow the generally oval contours of a human head. Likewise, the back 501 and the front portion 502 of the headgear structure 500 are spaced away from wearer thereof.

The front portion 502 of the headgear includes a suitable attachment mechanism 575, as previously described. A complementary attachment mechanism 675 is provided on the inner surface of the shroud 200.

The headgear 500 includes side sections 551 with a central mounting portion 522 which is adapted to provide a pivotal mounting location for an internal head band support similar to headband 107 described relative to FIG. 1. An adjustment knob similar to knob 109 shown and described relative to FIG. 1 is contemplated but is not shown in FIG. 5 for convenience. The knob is connected to the head band support through the connection hole 509 through the central mounting portion 522.

The lower front portion 503 is joined to the upper portion 550 by the side section 551. The front portion 503 is spaced away from the wearer's face and, thus, maintains the shroud 200 spaced away from the wearer's face. Back portion 501 substantially encircles the back of the wearer's head.

Thus, neither the structure 500, nor the shroud 200 supported thereby rest directly on the wearer's head. This arrangement permits air flow and circulation around the wearer's head, as described infra.

In the embodiment of FIG. 5, the upper portion 550 of the structure 500 is contoured to function as a portion of a fan housing. An aperture 537 through the surface of portion 550 is provided. In addition, a cage-like unit 561 which includes support struts 525 is mounted to or formed with structure 500. The support struts extend upwardly from a support band 562 and join together in a common top strip 563 which terminates at the top rear surface 565. The shroud 200 is disposed over the cage 561 with an air inlet (or outlet) filtration area 204 of the shroud adjacent to aperture 537.

The support struts or standoffs 525 of cage 561 extend slightly above the outer surface of upper portion 550 (and, thus, the aperture 537) to prevent the shroud 200 from coming into contact with the fan 520. In addition, the cage unit 561 maximizes the "effective" area of the filter portion of the shroud.

A liner 580 (see FIG. 7) is removably mounted within the upper portion of the headgear structure 500 and substantially follows the internal contours thereof. The liner 580 is fabricated of material similar to the headgear structure 500. A relatively flat portion of the liner is positioned opposite the aperture 537 through the upper portion 550 of the headgear structure. Fan 520 is mounted on the flat portion of the liner 580 adjacent aperture 537 in the headgear 500. One or more high efficiency fans 520 can be mounted adjacent to the aperture 537 in the upper portion 550 of the helmet. Typically, the fan 520 is a relatively small flat fan of the type shown in FIG. 1 and as described in detail hereinafter.

As in the embodiment shown and described relative to FIG. 1, air flow is generated from the back of the headgear 500 by fan 520 and is arranged to pass forwardly across the top of the wearer's head and down across the face of the wearer. (Of course, the air can be drawn out of the headgear structure by operating fan 520 as an exhaust fan.) In either direction, the air flow is substantially confined to the space between the inner liner 580 and the inner surface of upper portion 550 of the headgear structure 500. The air space operates as a hollow duct which communicates with fan 520. A slot 532 formed between the inner surface of upper portion 550 and the surface of liner 580 adjacent the forehead of the wearer directs air flow across the face of the wearer and the inside of the window.

Alternatively, in an exhaust mode, the airflow passes from the airspace, through the fan 520 in liner 580 and through the aperture 537 under cage 561 and then through the filter 204.

Figure 6:
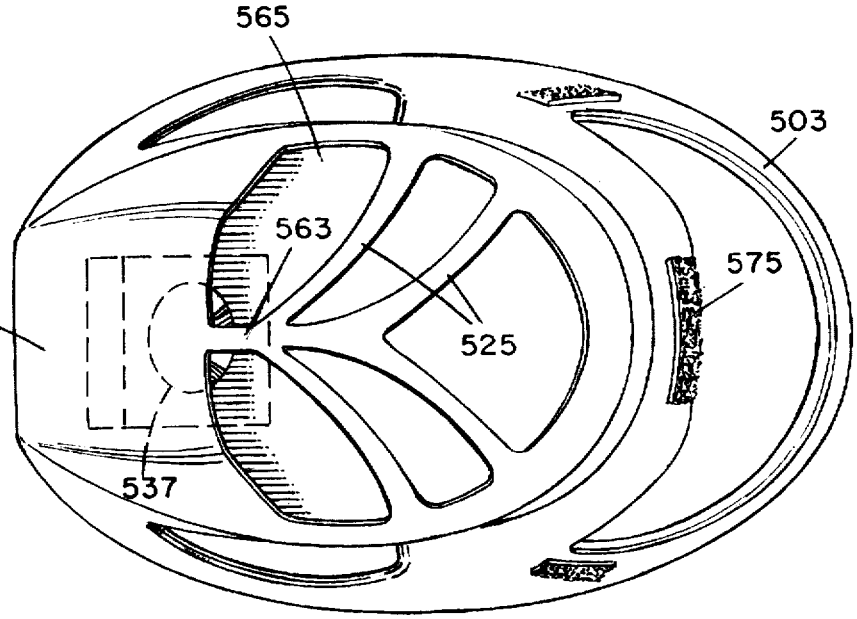
FIG. 6 is a top, plan view of the headgear structure embodiment shown in FIG. 5.

Referring now to FIG. 6, there is shown a top, plan view of the headgear structure (or helmet) 500. The cage-like structure 561 is mounted on the upper surface of the helmet 500. The cage 561 includes the support struts 525 and the common top strip 563. The connection device 575 is shown at the front of the headgear 500. The upper portion of the headgear is shown to be relatively smooth and rounded. The opening 537 in the surface 550 is shown in dashed outline. The back surface 501 is shown to be, generally, smooth.

Figure 7:
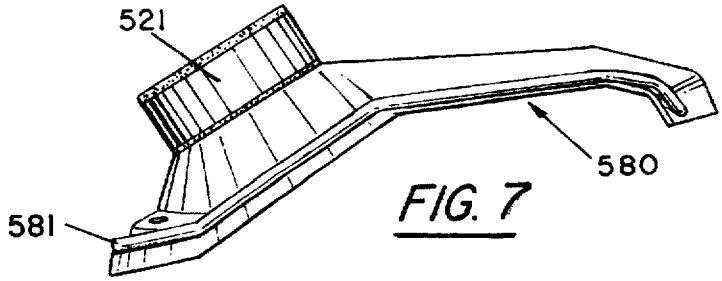
FIG. 7 is a side elevation view of the liner/fan support included within the headgear structure embodiment shown in FIGS. 5 and 6.

Referring now to FIG. 7, there is shown a side elevation view of the detachable liner 580 and the housing 521 for fan 520. The housing 521 is formed of the same (or similar) material as the headgear 500 and liner 580. The liner 580 is attached to the inside of helmet 500 with a friction fit or by suitable fasteners. A strip 581 of sealing material, such as a foam rubber strip, is affixed to the edges of liner 580 and forms an air seal between the headgear 500 and the liner 580.

Figure 8:
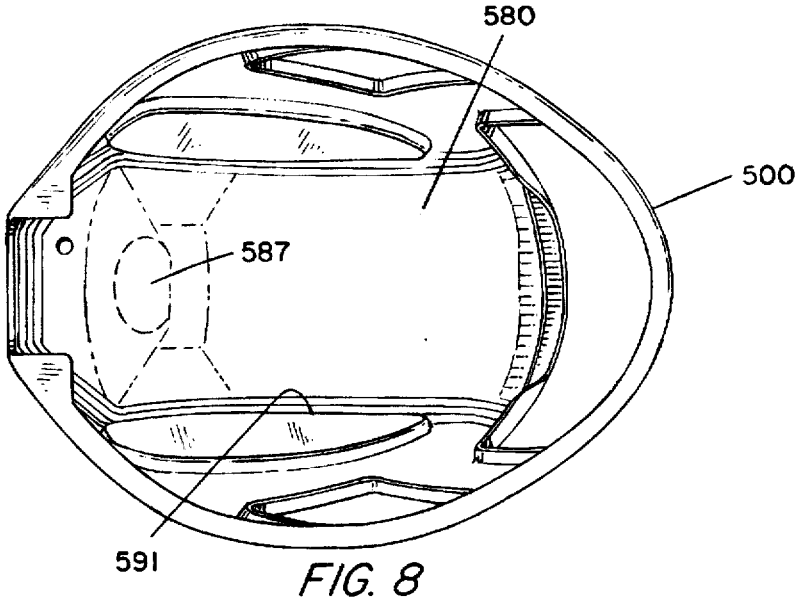
FIG. 8 is a plan view of the inside of the headgear structure embodiment shown in FIGS. 5 and 6 with the liner in place.

Referring now to FIG. 8, there is shown a plan view of the inside of liner 580 mounted in headgear 500. The support area for fan 520 is shown as a circular pad 587 although other configurations can be utilized. The peripheral ridge 591 is one illustrative design and adds structural strength to the liner.

Figure 9:
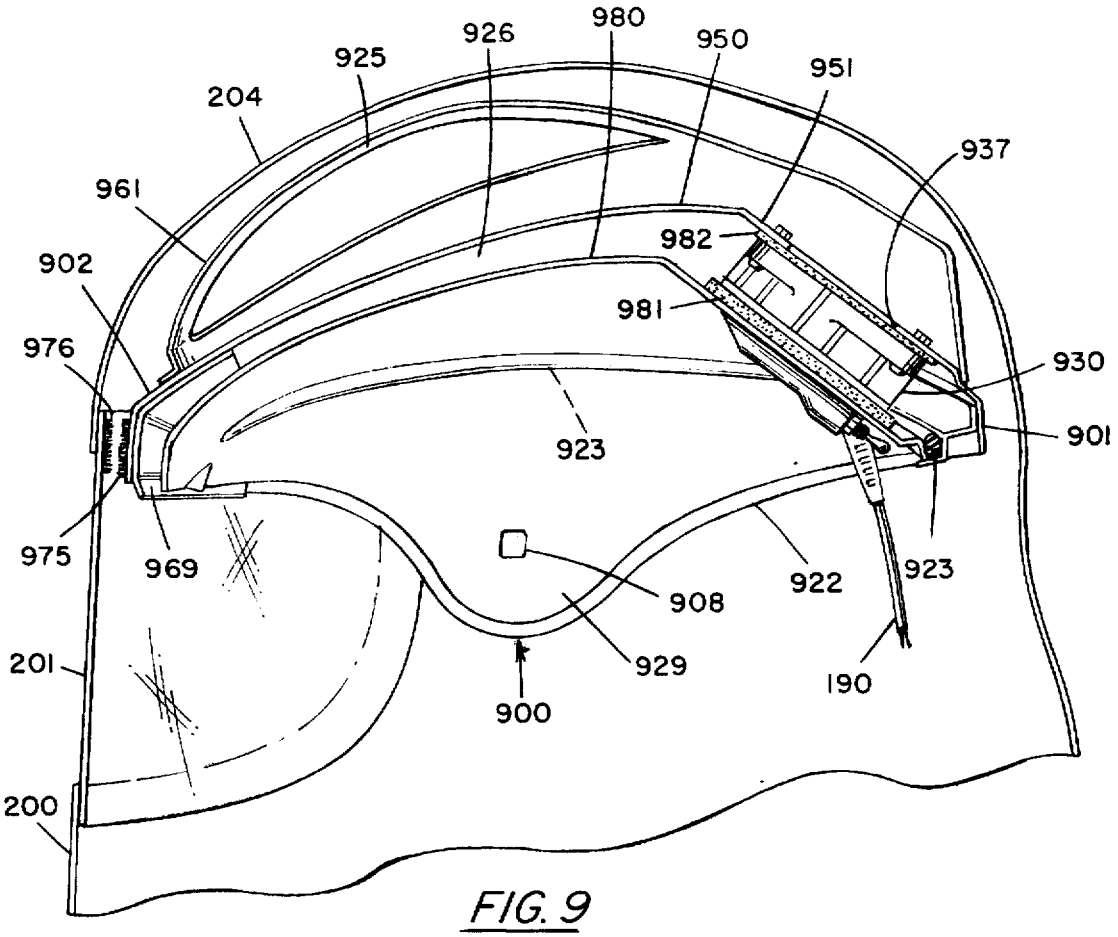
FIG. 9 is a cross-sectional view of another embodiment of the headgear structure of the instant invention.

Referring how to FIG. 9 there is shown a cross-sectional view of another embodiment of the instant invention. In this embodiment, similar components bear related reference numerals. The system includes a relatively rigid, lightweight headgear structure 900 which is selectively covered by a relatively limp shroud 200.

The structure 900, as in the case of structures 100 or 500, can be molded, stamped, vacuum formed, or fabricated in any suitable and appropriate fashion. The hood 200 is, preferably, formed of materials similar to those noted supra. The shroud includes a transparent, planar viewing shield 201. The headgear structure 900 is substantially similar to the structure 100 shown in FIGS. 1 and/or 5. That is, the upper (or cranial) portion 950 is configured to substantially follow the generally oval contours of a human head. Likewise, the back 901 and the front portion 902 of the headgear structure 900 are configured to be spaced away from wearer thereof. Thus, the shroud 200 and shield 201 are spaced away from the wearer's face.

A suitable attachment mechanism 975 is affixed to the upper front portion 902. A complementary attachment mechanism 976 is provided on the inner surface of the shroud 200.

In the embodiment of FIG. 9, the upper portion 950 of the structure 900 includes an outer shell 951 with an aperture 937 through the upper surface thereof. In addition, a cage-like unit 961 which includes support strut 925 is mounted to or formed with structure 900 above the outer shell 951.

The liner 980 includes a pivotal mounting location 908 in the temporal portion 929 for an internal headband support (not shown) similar to headband support 107. In this embodiment, the liner structure 980 may be substantially fixed relative to the headband liner. Thus, the structure 900 and the shroud 200 supported thereby do not rest directly on the wearer's head. This arrangement permits air flow and circulation around the wearer's head, as described infra.

The fan 930 is mounted on the liner 980 adjacent aperture 937 in the outer shell 951. The inner surface of the outer shell 951 (along with the outer surface of liner 980) defines a hollow duct-like channel 926. The channel 926 communicates with the exterior of the helmet via aperture 937. Thus, the fan 930 draws air in through filter 204 in shroud 200. The support strut 925 of cage 961 extends slightly above the outer surface of upper portion 950 to support the shroud 200 and, thus, maximizes the "effective" area of the filter portion of the shroud. The headgear 900 includes side sections 922 which engage the liner 980.

One or more high efficiency fans 930 can be mounted at the upper rear surface of liner 980. Typically, the fan 930 is a relatively small flat fan of the type shown in FIG. 1 and as described in detail hereinafter.

Air flow is generated from the back of the headgear 900 by fan 930 and passes forwardly across the top of the wearer's head and down across the face of the wearer via slot 969. (Of course, the air can be drawn out of the headgear structure by operating fan 930 as an exhaust fan.) More particularly, the air flow is through the shroud 200, through the openings in cage 961 to the fan 930. This air flow created by the fan is substantially confined to the space between the liner 980 and the inner surface of upper portion 951 of the headgear structure 900.

In the exhaust mode, the airflow passes from the airspace under the shroud, through the fan 930 on liner 980 and through the outlet 937 through cage 961. The shroud 200 is disposed over the cage 961 such that the outlet air passes through a filtration area 204 of the shroud 200.

The liner 980 is attached to the inside of helmet 900 with a friction fit or by suitable fasteners. A strip 923 of sealing material, such as a foam rubber strip, is affixed to the edges of liner 980 and forms an air seal between the headgear 900 and the liner 980.

In addition, a seal 981 is inserted between the fan 930 and the outer surface of liner 980. Another such seal 982 is inserted between the fan 930 and the inner surface of top portion 951. Typically, the seals 981 and 982 are fabricated of a soft, foam-like material and serves to seal the abutment of the surfaces in spaced apart relation and, as well, to prevent vibration thereof. This latter aspect tends to reduce the noise generated by the fan 930 and the air flow through the headgear structure by minimizing resonance.

Figure 10:
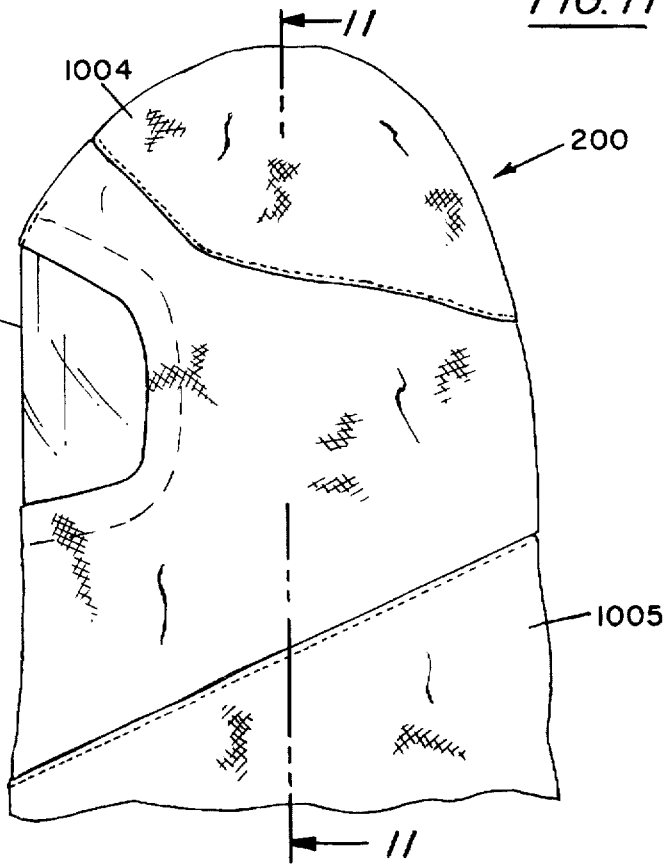
FIG. 10 is a view of one embodiment of the hood (or shroud) utilized with the headgear structures of the instant invention.

Referring now to FIG. 10, there is shown an elevation view of one embodiment of the shroud 200 which is shown in FIG. 1. The shroud 200 is, typically, a relatively thin, flaccid sheet of cloth, paper or the like. Single or multiple layers of material such as melt blown polypropylene, polyolefins or the like, can be used, if desired. The shroud 200 is, preferably, arranged as a pre-formed hood which is selectively placed over the headgear structure 100 and selectively attached thereto by means of the connector mechanisms 175 and 575 which can include snaps, hook-and-loop fasteners, or the like. (Of course, the same type of shroud or hood can be used with the headgear structures 500 and/or 900.)

Typically, shroud 200 is made to fit reasonably snugly to the headgear structure in order to remain in the preferred position and orientation. For example, the shroud is draped free-form over the upper portion of the headgear and down beyond the rear portion thereof to completely envelop the head and shoulders of the wearer. Typically, the shroud extends past the lower surface of the helmet and may be about 36 inches wide and 30 inches long. Of course, these dimensions are not limitative of the invention. However, the shroud 200 preferably extends over the shoulders of the wearer to provide a reasonably secure sphere of influence relative to the wearer's head. This arrangement contains the air flow and filtration control system as well as providing a containment device for limiting contamination to or by the wearer.

A substantially planar, transparent shield 1001 is included in an opening in shroud 200 and mounted in front of the headgear. Typically, the shield 1001 is fabricated of a thin, optically clear, lightweight sheet of plastic such as PETG film which can be stamped, molded or the like.. Preferably, the shield can be radiation sterilized without discoloring. The shield can be sewn, taped, or otherwise secured in the shroud 200. The transparent shield 1001 generally conforms to the configuration of the headgear. Thus, it is curved slightly around the face of the wearer so that peripheral vision is permitted. However, the curvilinear surface is curved in only one plane, without any compound curvature, and produces very little visual distortion to the wearer.

Typically, the shroud, per se, may be formed of an impervious material for prevention of transmission of contaminants (in either direction). In the preferred embodiment, the shroud 200 includes at least a portion thereof which operates as a filter. It is contemplated, of course, that the entire shroud, per se, may be fabricated of a material which operates as a filter. Alternatively, one or more areas of filter material such as filter 1004 and/or filter 1005, is mounted directly into the shroud 200, for example by sewing, taping, gluing or the like. (Alternatively, the shroud 200 can incorporate a plurality of pockets into which filters can be selectively and replaceably mounted.) In one embodiment, filter 1004 is arranged to interact with a fan in the headgear (see supra). The fan can draw air through filter 1004 whereupon, the wearer receives clean, filtered air input.

The air then exhausts through filter 1005 (which can be virtually the entire hood), or any portion of the hood so designed. Thus, filtered air is exhausted into the ambient. Also, air pressure within the system remains balanced. This can be especially important in surgical applications of the invention.

If so designed, as with shroud material of a composition which acts as a filter, the air to be exhausted is forced through the shroud surface 1005 by the slight positive pressure differential created by forcibly intaking air through filter 1004.

Conversely, if the design creates a slight negative pressure, for example with filter area 1004 being used to forcibly exhaust air, the shroud surface 1005 will act to filter air entering the system.

Figure 11:
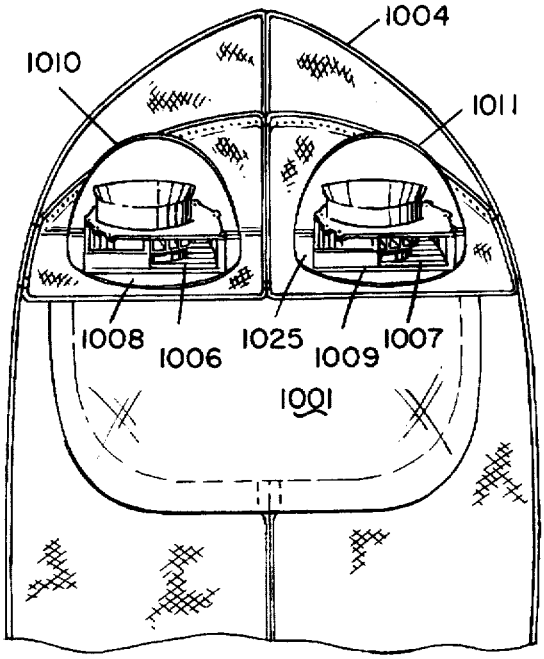
FIG. 11 is a cross-sectional view of the embodiment of the hood shown in FIG. 10 taken along the lines 11—11.

As shown in FIG. 11, the filter portion 1004 of the shroud 200 includes the filter material 1004 arranged in a generally pointed or conical cap configuration. This portion, while flacid, can assume a substantially upright position to maximize the filtration area.

Beneath the filter portion 1004 is a support membrane 1025 which is sewn into the shroud. A pair of openings 1006 and 1007 are formed in the membrane 1025. Thin layers 1008 and 1009 of a semi-rigid plastic are adhered to the membrane 1025. The layers 1008 and 1009 are cut to provide flaps 1010 and 1011 of substantially semi-circular configuration. Thus, the flaps 1010 and 1011 are hingedly attached to the layers 1008 and 1009, respectively. The flaps are disposed in juxtaposition to the openings 1006 and 1007.

Figure 12:
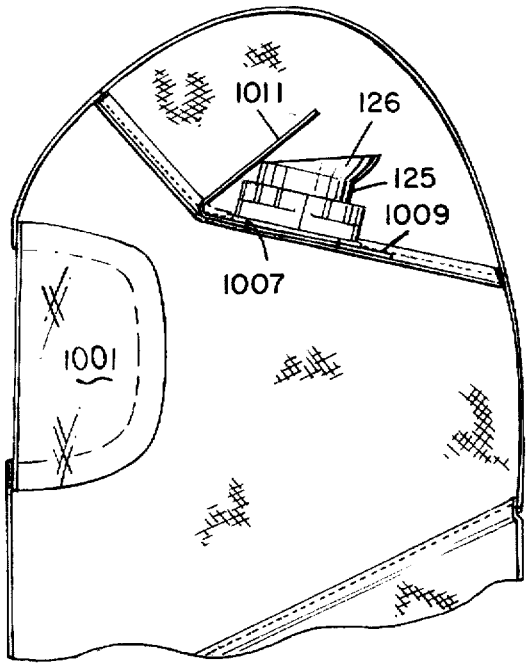
FIG. 12 is a cross-sectional view of the embodiment of the hood shown in FIG. 10.

As shown in FIG. 12, the port 125 from the headgear shown in FIG. 1 is selectively passed through opening 1007 in layer 1009. The lip 126 tends to engage the layer 1009 to retain the shroud 200 in a preferred orientation relative to the helmet. Of course, the opening 1006 can be employed, as well. Alternatively, a helmet with a pair of outlet ports can be utilized.

Furthermore, it is clear that the flap 1011 is maintained in the upright position when the port 125 is inserted through the opening 1007. The flap 1011 tends to assist in maintaining the filter 1004 in the erect position as noted above.

In one embodiment, the shield 1001 may include a thin layer 1070 or coating of anti-fogging material to prevent fogging of the shield.

In the preferred embodiment, the shroud 200 and the filters (uniform or discrete) are intended to be disposable. This arrangment has a distinct advantage over prior art systems with built-in, permanent filters. That is, any contaminants, bacteria or the like which are trapped in the filter are discarded with the disposable filter or shroud. The possibility of contamination in reusable filters or shrouds is avoided by this device. Moreover, the filters are preferrably able to filter out particulate up to 0.1 micron. In addition, the filter areas can be formed of multiple layers of filter material including a layer of carbon which can filter odors as well as other particulate-like materials.

Figure 13:
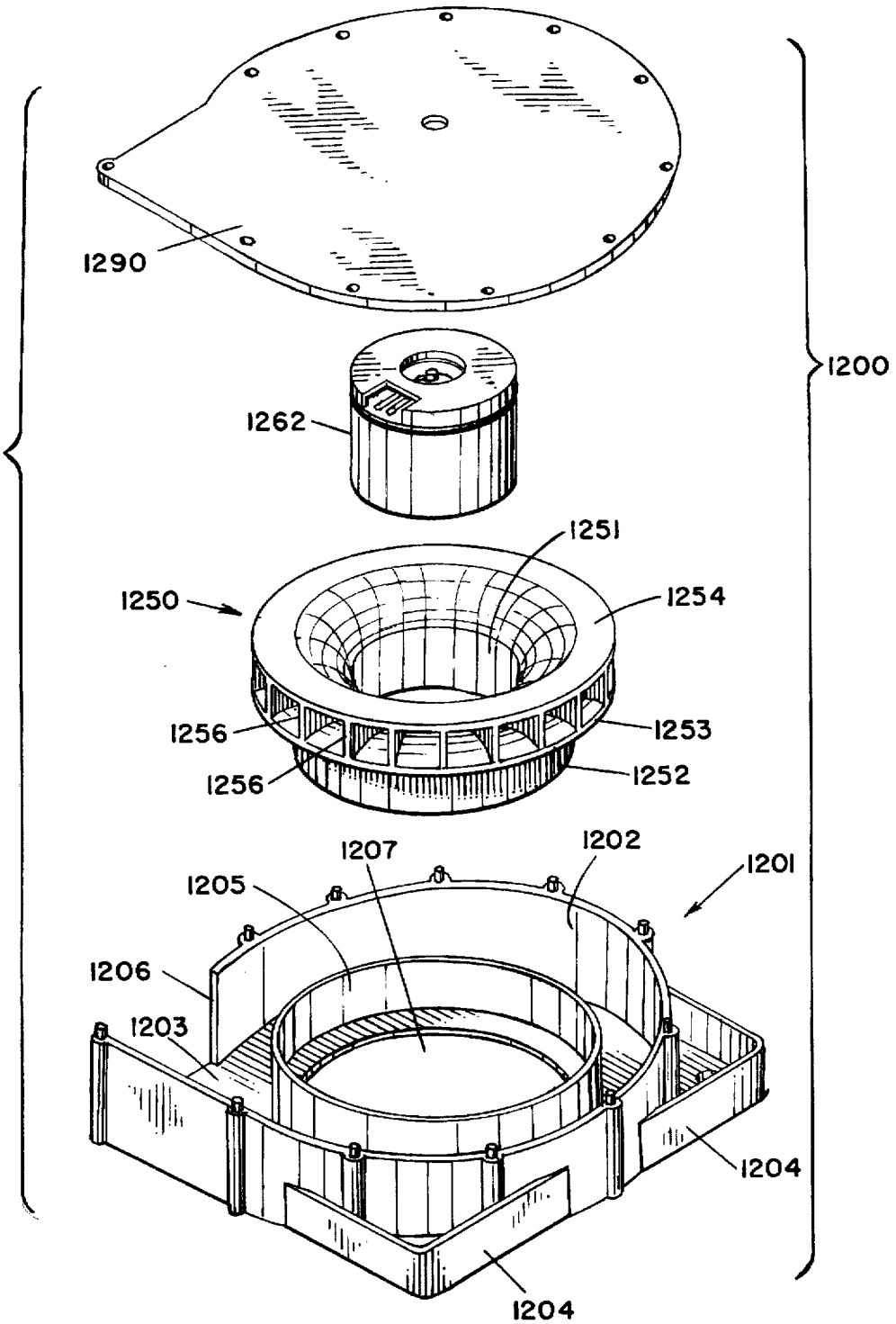
FIG. 13 is an exploded view of one embodiment of a fan utilized with the headgear structures shown in FIGS. 1 and 5.

Referring now to FIG. 13, there is shown an exploded view of a fan 1200 which is equivalent to the fan 120 (FIG. 1), fan 520 (FIG. 5) and/or fan 920 (FIG. 9). The fan 1200 includes a volute body 1201 which includes a generally spiral-shaped surface 1202. The surface 1202 is, in this embodiment, in the form of a wall which is mounted on a support base 1203. The support base 1203 includes mounting ears 1204. In addition, support base 1203 provides one surface of the volute chamber.

An inner surface 1205 is, generally, a circular shaped wall formed on the support base 1203 along with the surface 1202. Thus, inner surface 1205, base 1203 and outer surface 1202 form a spiral-shaped chamber with an opening 1206 at one side thereof.

A fan blade 1250 is mounted on the shaft of motor 1262 which is mounted to bottom plate 1290. The fan blade is, thus, positioned relative to the inner surface 1205 and inlet opening 1207. The fan blade (or impeller) includes a plurality of individual blades (described hereinafter) which form spaces therebetween. The spaces communicate with openings in the lower surface of impeller 1250 (as shown in FIG. 13). The motor 1262 causes the impeller to rotate about the central axis thereof. As the impeller 1250 rotates it carries (or forces) air through the fan. Thus, air is passed through the volute input opening 1207 through the fan openings and out the outlet port 1206 in the surface 1202.

A fan top plate 1290 is configured to enclose the top surface of the fan housing, in particular the volute 121. This assembly forms the air path for the fan. The top plate 1290 is fastened to the volute wall 1202 in any conventional or convenient manner.

Figure 14:
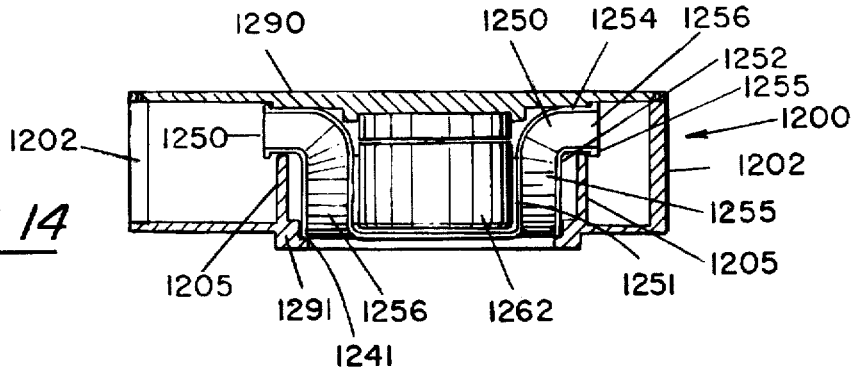
FIG. 14 is a cross-sectional view of the fan embodiment shown in FIG. 13.

Referring now to FIG. 14, there is shown a cross-sectional view of the fan 1200 shown in FIG. 13 after assembly. In FIG. 14, the outer wall 1202 of the volute is shown surrounding the inner wall 1205 of the volute. The impeller 1250 is shown mounted within the inner wall 1205 and adjacent the ledge 1241 in the volute bottom. The motor 1262 is mounted on the cover 1290 and within the impeller 1250. The volute cover 1290 is attached to the volute body 1202 by any suitable means such as locking pins on outer wall 1202. The blades are shown mounted in the fan impeller.

Referring concurrently to FIGS. 13 and 14, there is shown a partially broken away, cross-sectional view of one embodiment of the impeller blade 1250. The impeller blade is formed of an inner wall 1251 and an outer wall 1252. The inner and outer walls are concentric cylinders with one end of each in a co-planar arrangement. The outer wall 1252 includes a flange 1253 which extends outwardly therefrom and substantially normal thereto. The inner wall 1251 includes a flange 1254 which extends outwardly therefrom and is disposed above the outer wall flange 1253. The lower flange 1254 is substantially parallel to the upper flange 1253 outside the outer cylinder 1252. However, at the inner portion thereof, each flange joins the respective cylinder in a smooth, curvilinear surface.

The inner and outer cylinders (and the respective flanges) are separated by a plurality of fan blade sets which are joined to each of the cylinders and flanges.

In one set, each of the blades 1255 is a relatively short, L-shaped planar blade. The back of blade 1255 is joined to the inner cylinder wall and conforms to the curvilinear portion thereof. The front of blade 1255 is joined to the inner surface of the outer cylinder and conforms to the cylinder wall and the flange thereof. One end of blade 1255 is co-planar with the outer edges of the upper and lower flanges. The other end of blade 1255 extends about halfway along the walls of the inner and outer cylinders but stops short of the co-planar ends thereof.

The other set comprises of blades 1256, each of which has a compound bend or twist configuration which is loosely defined as L-shaped. Again, one end of blade 1256 is co-planar with the outer edges of the flanges. The vertical leg of blade 1256 is joined to the surfaces of the concentric cylinders and extends to the co-planar edges thereof. However, the vertical leg includes a bend therein whereby the vertical leg extends over the top of the short blade 1225. Moreover, the vertical leg of blade 1256 also curves slightly from the joint in the inner cylinder wall to the joinder with the outer cylinder wall.

This construction creates a channel between the twisted blades 1256 and the walls of the inner and outer cylinders. However, the channel is substantially bisected at the end thereof by the shorter blades 1255 which are joined to the flanges. This arrangement tends to maximize air movement by the fan with minimum turbulence and attendant noise factor.

Thus, there is shown and described a preferred embodiment of the instant invention. The particular configuration shown and described herein relates to an air flow and filtration control system. While this description is directed to a particular embodiment, it is understood that those skilled in the art may conceive modifications and/or variations to the specific embodiments shown and described herein. For example, each fan may be replaced by multiple fans; the specific structure of the headgear skeleton and/or liner may be altered; the types of materials may be varied, or the like. Also, in a modification of this embodiment, the lower portion 103 can be made in the form of a channel or duct whereby air can be exhausted therethrough. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. An air flow filtration system comprising, a headgear structure adapted to be mounted on the head of a wearer, liner means adapted to be mounted within said headgear structure to form a channel between said liner means and said headgear structure, a shroud which is selectively mounted on said headgear structure, a transparent shield mounted to said shroud, fan means mounted at said headgear structure adjacent to said liner means to create fluid flow through said channel, said fan means comprises a volute body, impeller means rotatably mounted within said volute body, and motor means mounted within said impeller means in order to cause said impeller means to rotate relative to said volute body, housing means for supporting said fan means, at least one of said liner means and said fan means is removably attachable to said headgear structure, and filter means in said shroud whereby fluid flow created by said fan means is filtered through said filter means.

2. The system recited in claim 1 including, support strap means pivotally mounted to said headgear structure and adapted to snugly engage the head of the wearer.

3. The system recited in claim 1 wherein, said filter means comprises distinct portions of said shroud means.

4. The system recited in claim 3 wherein, said filter means is attached to said shroud means.

5. The system recited in claim 1 wherein, said fan means comprises intake fan means.

6. The system recited in claim 5 wherein, said fan means comprises outlet fan means.

7. The system recited in claim 5 wherein, said fan means consists of a single fan.

8. The system recited in claim 1 wherein, said transparent shield is substantially a single plane.

9. The system recited in claim 1 wherein, said channel transmits fluid to or from said fan means.

10. The system recited in claim 1 wherein, said transparent shield is defined by a single curvilinear plane.

11. The system recited in claim 1 wherein, said shroud is formed of material which filters to 0.1 micron.

12. The system recited in claim 1 including connection means for connecting said shroud to said headgear structure.

13. The system recited in claim 1 wherein, said headgear structure includes a rigid frame which substantially surrounds the head of the wearer and includes an upper portion, a lower front portion and a lower back portion, all of which are joined together.

14. The system recited in claim 1 including, standoff means disposed on said headgear adjacent said fan means in order to space said shroud from said fan means.

15. The system recited in claim 14 wherein, said standoff means comprises a cage-like structure mounted at the top of said headgear structure.

16. The system recited in claim 1 wherein, said headgear structure comprises a high impact plastic material.

17. The system recited in claim 1 wherein, said housing means includes port means extending outwardly from said housing means.

18. The system recited in claim 17 wherein, said shroud means includes support means adapted to engage said port means of said housing means.

19. The system recited in claim 1 wherein, said fan means is mounted to said liner means.

20. The system recited in claim 1 including, sealing means interposed between said liner means and said headgear structure.

21. An air flow filtration system comprising, a headgear structure adapted to be mounted on the head of a wearer, liner means mounted within said headgear structure to form a channel between said liner means and said headgear structure, a shroud which is selectively mounted on said headgear structure, a transparent shield mounted to said shroud, fan means mounted at said headgear structure adjacent to said liner means to create fluid flow through said channel, filter means in said shroud whereby fluid flow created by said fan means is filtered through said filter means, housing means for supporting said fan means, said housing means includes port means extending outwardly from said housing means, said shroud means includes support means adapted to engage said port means of said housing means, said support means includes an opening for receiving said port means, and flap means joined to said support means such that said flap means is elevated by said port means when said port means is received in said opening.

22. The system recited in claim 21 wherein, said support means is disposed adjacent to said filter means in said shroud.

23. The system recited in claim 21 wherein, said housing means is mounted adjacent the back portion of said headgear structure and adjacent said liner means whereby said fan means creates fluid flow through said channel.

* * * * *